US008757043B2

(12) United States Patent
Hagedorn et al.

(10) Patent No.: US 8,757,043 B2
(45) **Date of Patent: *Jun. 24, 2014**

(54) WEAPON MOUNTING SYSTEM FOR FIREARMS

(71) Applicants: Mark Edward Hagedorn, Hendersonville, TN (US); Joe Bebee, Gallatin, TN (US)

(72) Inventors: Mark Edward Hagedorn, Hendersonville, TN (US); Joe Bebee, Gallatin, TN (US)

(73) Assignee: H & H Tool Shop, LLC, Gallatin, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/950,997

(22) Filed: Jul. 25, 2013

(65) Prior Publication Data

US 2014/0116237 A1 May 1, 2014

Related U.S. Application Data

(60) Provisional application No. 61/718,253, filed on Oct. 25, 2012.

(51) Int. Cl.
*F41A 23/00* (2006.01)
*F41A 27/30* (2006.01)

(52) U.S. Cl.
CPC ..... *F41A 27/30* (2013.01)
USPC ..... 89/37.03

(58) Field of Classification Search
USPC ..... 89/37.01, 37.03, 40.03, 37.04; 224/553; 248/276.1, 278.1, 282.1, 284.1; 403/164, 165
See application file for complete search history.

(56) References Cited

U.S. PATENT DOCUMENTS

| | | | | |
|---|---|---|---|---|
| 787,119 | A | 12/1904 | Quincy | |
| 2,051,034 | A | 8/1936 | Ferguson | |
| 2,143,900 | A | 1/1939 | Rarey | |
| 3,504,122 | A | 3/1970 | Ratliff | |
| 3,601,598 | A * | 8/1971 | Horn | 362/418 |
| 3,711,984 | A | 1/1973 | Dyer | |
| 4,434,703 | A * | 3/1984 | Fog et al. | 89/37.03 |
| 4,592,526 | A * | 6/1986 | Kobelt | 248/284.1 |

(Continued)

FOREIGN PATENT DOCUMENTS

| | | |
|---|---|---|
| DE | 2033501 B2 | 11/1976 |
| DE | 19531119 A1 | 2/1997 |

(Continued)

OTHER PUBLICATIONS

Bishop, Chris, The encyclopedia of tanks & armored fighting vehicles : from World War I to the present day, 2006, p. 257, Thunder Bay Press, San Diego, California.

(Continued)

*Primary Examiner* — Reginald Tillman, Jr.
(74) *Attorney, Agent, or Firm* — Kelly J. Hollowell; Waller Lansden Dortch & Davis, LLP

(57) ABSTRACT

The present disclosure provides a weapons mounting system, which may include a gun mount that may be used independent of a swing mount or with the swing mount. The gun mount may include a Picatinny rail assembly and be attached to an ammunition container. The swing mount may include a positive locking system and a friction locking system. The present disclosure also provides a travel lock assembly, which partially connects the gun mount to the swing mount.

26 Claims, 19 Drawing Sheets

(56) References Cited

U.S. PATENT DOCUMENTS

| | | | | |
|---|---|---|---|---|
| 4,726,552 | A | 2/1988 | Warshawsky | |
| 4,783,036 | A | 11/1988 | Vossoughi | |
| 4,821,159 | A | 4/1989 | Pike | |
| 5,036,754 | A | 8/1991 | Simms et al. | |
| 5,060,410 | A | 10/1991 | Mueller | |
| 5,335,578 | A | 8/1994 | Lorden | |
| 5,342,137 | A | 8/1994 | Peng | |
| 5,476,241 | A | 12/1995 | Helman | |
| 5,697,181 | A | 12/1997 | Savant | |
| 5,772,174 | A | 6/1998 | Hirsch | |
| 5,913,667 | A | 6/1999 | Smilee | |
| 6,058,641 | A | 5/2000 | Vecqueray | |
| 6,095,468 | A * | 8/2000 | Chirico et al. | 248/282.1 |
| 6,209,835 | B1 | 4/2001 | Walrath et al. | |
| 6,237,462 | B1 | 5/2001 | Hawkes et al. | |
| 6,283,428 | B1 * | 9/2001 | Maples et al. | 248/282.1 |
| 6,286,411 | B1 | 9/2001 | Sanderson | |
| D515,168 | S * | 2/2006 | Ruhland et al. | D22/108 |
| 7,415,790 | B1 * | 8/2008 | Ruhland et al. | 42/94 |
| 7,677,515 | B2 * | 3/2010 | Oddsen et al. | 248/274.1 |
| 2002/0080571 | A1 | 6/2002 | Beger | |
| 2008/0092732 | A1 * | 4/2008 | Becker et al. | 89/37.03 |

FOREIGN PATENT DOCUMENTS

| | | | |
|---|---|---|---|
| EP | 899533 | A2 | 3/1999 |
| GB | 432132 | A | 7/1935 |
| GB | 579193 | A | 7/1946 |
| JP | 4142507 | A | 5/1992 |

OTHER PUBLICATIONS

Hunnicutt, R.P., Armored car : a history of American wheeled combat vehicles, 2002, pp. 126, 142, 147 and 218, Presidio Press, Novato, California.

Tucker, Spencer, Tanks : an illustrated history of their impact, 2004, p. 307, ABC-CLIO, Santa Barbara, California.

Pope, Dudley, Guns; from the invention of gunpowder to the 20th century, 1965, Delacorte Press, New York, New York.

Jobe, Joseph, Guns, an illustrated history of artillery, 1971, p. 193, London, Stephens.

Turner, Jason, Tracked firepower : today's armored fighting vehicles, 2002, MBI Pub., St. Paul, Minnesota.

* cited by examiner

WEAPON MOUNTING SYSTEM FOR FIREARMS

RELATED APPLICATIONS

This application claims priority to U.S. Provisional Application No. 61/718,253, filed Oct. 25, 2012, the contents of which are incorporated herein by reference in their entirety.

FIELD OF INVENTION

The present invention relates to the general field of firearms. It is specifically related to systems for mounting various firearms.

BACKGROUND OF INVENTION

The use of various mounting devices with firearms and weapons is well known. Gun mounts have typically been designed and built for specific firearms. One such swing arm mount system is described in U.S. Pat. No. 6,283,428 and another is described in U.S. Pat. No. 7,415,790.

In the past, a ball lock pin system with a pintle, or a through the arm bolt system have been used for tightening a collar around a pintle for friction locking. Previously, the only way to frictionally tighten the attachment of the pintle and the swing arm has been to tighten a bolt disposed inward from the knuckle on the lower swing arm aft of the forward knuckle and forward of the aft knuckle. The prior art used through bolts with knobs on them that squeeze the arm and tighten the arm around the pivot post, thus indirectly tightening the pivot post within the arm. Turning the knobs and associated bolts squeezes the pintle indirectly and produces only a marginal friction lock at best. Such an arrangement does not result in a positive locking system.

Accordingly, there exists a need for a weapons mounting system that can function with various firearms and mount directly to the weapon mount configuration, so that multiple firearms can be independently interchanged in the same configuration of firearm mount and accessories without removing any attachments such as lasers and lights from the firearms.

SUMMARY

In one embodiment, the invention provides a knob locking assembly that includes: a) a pintle housing, the pintle housing having an interior comprising a socket and an exterior; b) a rotatable adjustment knob attached to said pintle housing and rotatable relative to said pintle housing, the rotatable adjustment knob having an interior surface facing the pintle housing and an opposing exterior surface facing away from the pintle housing; c) a disk having a circumference and a plurality of teeth and valleys disposed about said circumference, said disk situated between said pintle housing and said rotatable adjustment knob; and d) a disk pin attached to said knob interior surface, said disk pin engaging a valley in said disk, wherein rotation of said rotatable adjustment knob relative to said pintle housing causes said disk pin to rotate relative to said pintle housing and disengage from said valley and engage another valley in said disk.

In another embodiment, the invention provides an arm assembly for a firearm that includes a) an arm, the arm having a pintle housing, said pintle housing having an interior comprising a socket and an exterior; b) a pintle disposed in said socket, said pintle having a groove that extends around said pintle at a first pintle height, and a plurality of substantially circular recesses disposed about said pintle at a second pintle height; c) a rotatable adjustment knob attached to said pintle housing and rotatable relative to said pintle housing; d) a locking pin configured to engage a substantially circular recess in said pintle and inhibit said pintle from rotating in said socket; and e) a moveable collar comprising a tongue, said moveable collar operably connected to said adjustment knob, wherein rotation of said adjustment knob causes said tongue to engage said groove in said pintle and inhibit said pintle from rotating in said socket and retracting from said socket.

In another embodiment, the invention provides a travel lock assembly that includes a) a first arm, the first arm having two first arm travel lock apertures; b) first and second travel lock arms, said travel lock arms each having a pivot aperture and a gun mount aperture; c) a travel lock pivot bolt inserted through said first arm travel lock apertures and said pivot apertures; and d) a gun mount configured to receive a firearm, the gun mount having a pair of gun mount travel lock apertures, said first and second travel lock arms having a storage position wherein said travel lock arms are substantially parallel to said first arm, and a travel lock position wherein said travel lock arms are at an angle of at least 30 degrees relative to said first arm.

In yet another embodiment, the invention provides a Picatinny rail adapter (i.e., an assembly for mounting an apparatus with a Picatinny rail) that includes a) a Picatinny rail assembly center block, the block having a forward end, an aft end, a block length extending from the forward end to the aft end, left and right sides, a block width extending from the left side to the right side, a substantially flat top, and recesses in said left and right sides, said recesses extending substantially the entire length of said block; b) a left plate, said left plate having a forward end, an aft end, a length extending from said forward end to said aft end, a left side, a right side configured to face said block, a width extending from said left side to said right side of said left plate, a substantially v-shaped recess in said right side of said left plate and extending substantially the entire length of said left plate; c) a right plate, said right plate having a forward end, an aft end, a length extending from said forward end to said aft end, a left side configured to face said block, a right side, a width extending from said left side to said right side, a substantially v-shaped recess in said left side of said right plate and extending substantially the entire length of said right plate; and d) a fastener for attaching said left and said right plates to said block, wherein when said left and right plates are attached to said block by said fastener, said assembly comprises a Picatinny recess, said Picatinny recess having a floor defined by the top of said block, a left side defined by said left plate, and a right side defined by said right plate.

In yet another embodiment, the invention provides an ammunition container and gun mount assembly that includes a) a gun mount configured to receive a firearm, the gun mount having a forward end, an aft end, a gun mount length extending from said forward end to said aft end, a left side, a right side, and a gun mount width extending from said left side to said right side, said gun mount width being shorter than said gun mount length; and b) an ammunition container configured to feed ammunition to a firearm mounted in said gun mount, the ammunition container mounted to said left side or said right side of said gun mount, the ammunition container comprising i) a top side facing the sky, the top side disposed at an angle of between about 15 degrees and about 45 degrees relative to the ground, the top side comprising a feed opening for feeding ammunition from the ammunition container into the firearm; ii) a bottom side opposite the top side and facing the ground; iii) an interior side facing the gun mount; and iv) an exterior side opposite the interior side and facing away from the gun mount.

BRIEF DESCRIPTION OF THE DRAWINGS

These and other features, aspects, and advantages of the invention will become better understood with regard to the following description, appended claims, and accompanying drawings where:

DETAILED DESCRIPTION OF THE INVENTION

Figure 1:
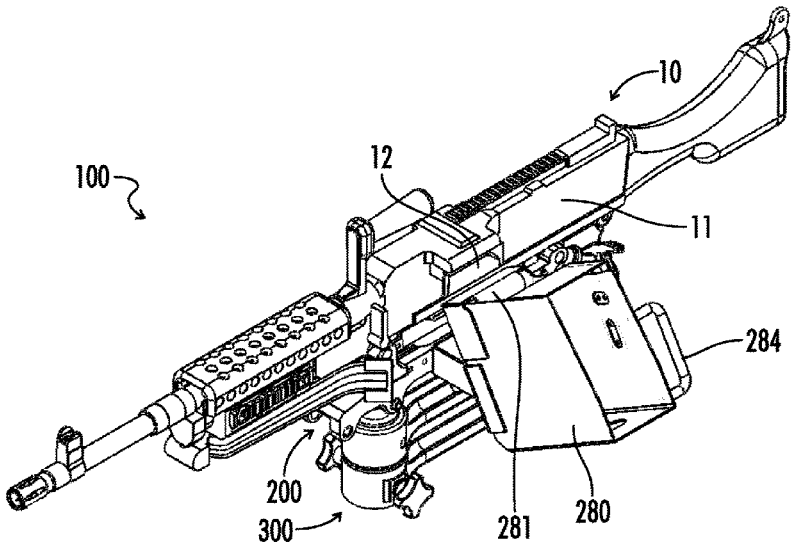
FIG. 1 is an isometric of one embodiment of a weapon mounting system with a gun mount, a swing arm assembly, an angled ammunition container, and a firearm.

The present invention relates to the general field of firearms. More specifically, the present invention relates to weapons mounting systems for mounting firearms with vehicles and other fixtures. The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein.

Overview

There is a need for a versatile, light-weight, durable, stable weapon mounting system 100 for firearms that accomplishes numerous functions and may be used with a number of different firearms and for various applications. The function and utility of the weapon mounting system 100 is to attach a firearm 10 with a vehicle 30 or fixed mounting location 30 such that the firearm is operable from a variety of positions, and can be locked or moved between positions with different levels of force depending on the user or operator's preference and the situation.

As illustrated in FIGS. 1 through 3, and 11, a weapon mounting system 100 is combined with a firearm 10 and a mounting location 30. The weapons mounting system 100 may include a gun mount 200 that may be used in conjunction with or independent of a swing mount 300. In addition, the weapons mounting system 100 may be used with the swing mount 300 independent of the gun mount 200.

As illustrated in FIGS. 2, 4 through 8, and 10, the gun mount 200 may include universal pintle adapter ("UPA") apertures 221, swing mount pivot point apertures 230, travel lock apertures 234, traverse and elevating ("T & E") mechanism apertures 238, forward and aft firearm attachment apertures 210, 212, ammunition container mounting apertures 282, low profile ammunition containers 280, shields 296 for protecting the gun mount 200 from extracted ammunition rounds, and a Picatinny rail adapter 260 for mounting a firearm 10 with a Picatinny rail.

Figure 2:
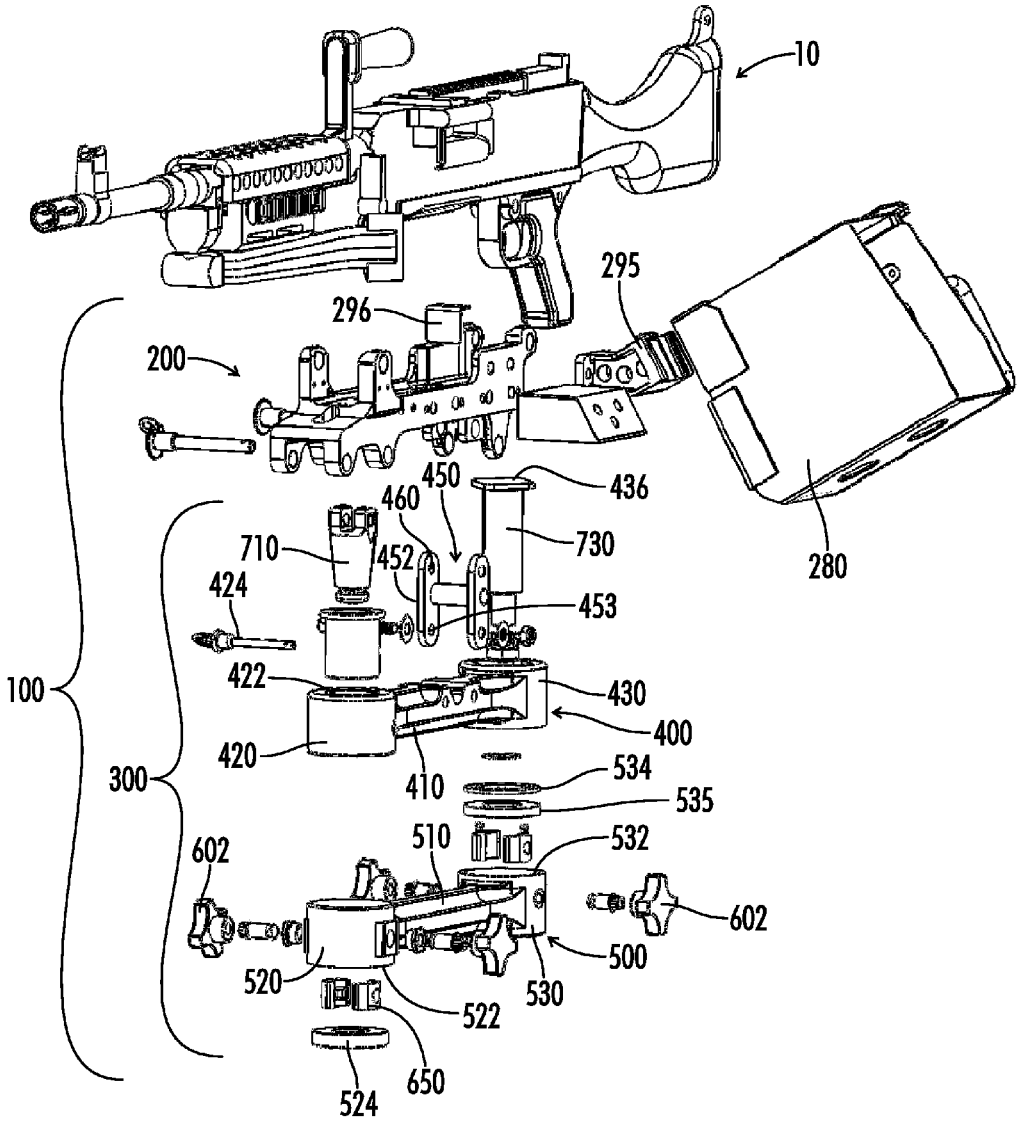
FIG. 2 is an exploded view of FIG. 1.
Figure 12:
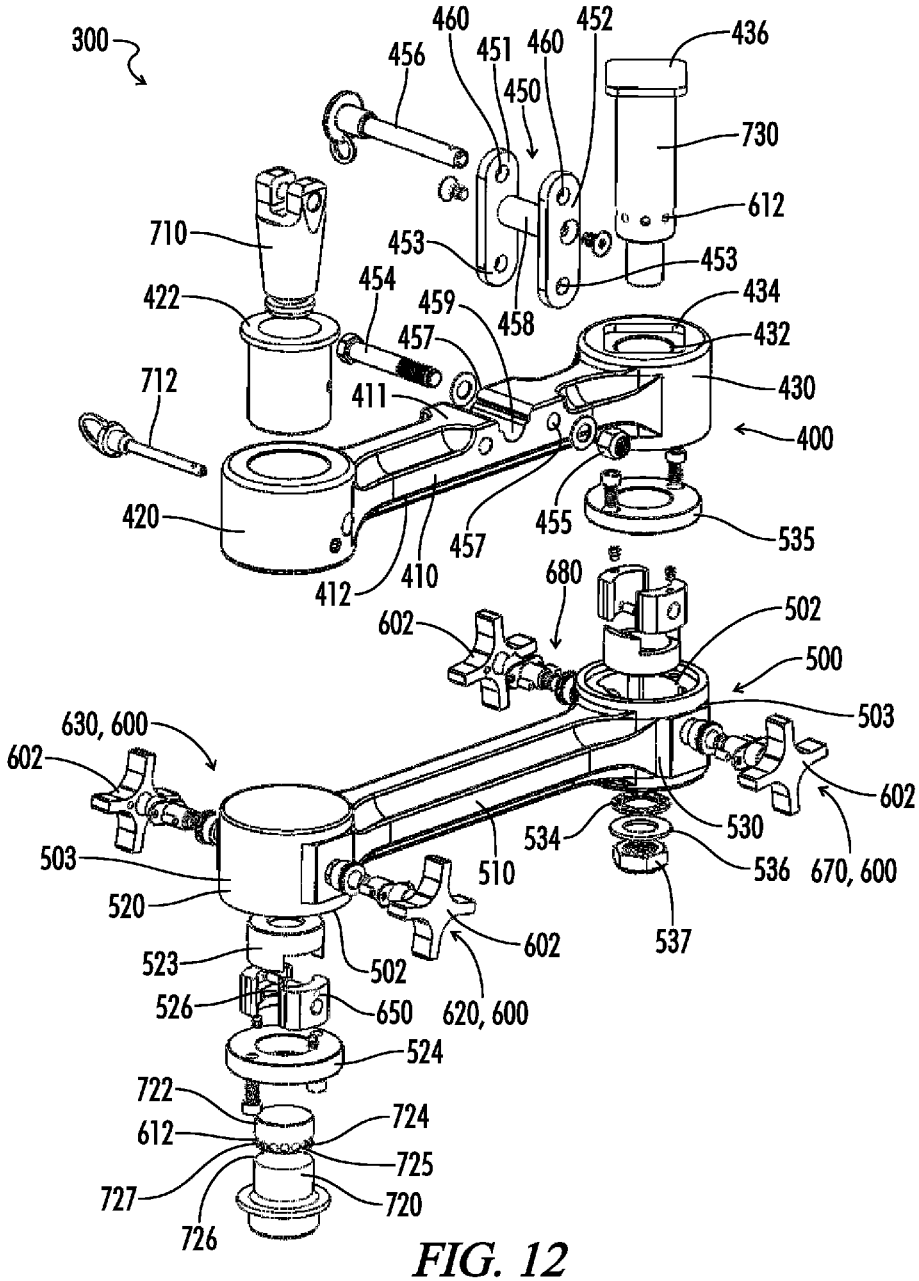
FIG. 12 is an exploded view of one embodiment of a swing mount depicting a first and second swing arm assembly.

As illustrated in FIGS. 2 and 12, the swing mount 300 may include a first swing arm assembly 400, a second swing arm assembly 500, and an aft pivot point pintle 730. The first swing arm assembly 400 may include a forward knuckle 420 with a gun mount pintle socket 422 for a gun mount pintle 710, a gun mount pintle ball lock pin 424, a first swing arm 410, a travel lock assembly 450, a travel lock ball lock pin 456, a travel lock pivot bolt 454, an aft knuckle 430 with a pivot point pintle socket 432. The second swing arm assembly 500 may include a forward knuckle 520 with a mounting bracket pintle socket 522, a forward knuckle positive locking knob assembly 620 with retaining collar 650, a forward knuckle friction locking knob assembly 630 with retaining collar 650, a second swing arm 510, an aft knuckle 530 for a second aft pivot pintle socket 532, an aft knuckle positive locking knob assembly 670, an aft knuckle friction locking knob assembly 680. It will be apparent from the following design specification that a number of safety features have been incorporated into the weapons mounting system for firearms.

Design Specifications

Gun Mount 200:

As shown in FIGS. 1 through 11, the gun mount 200 may be one or more pieces. The gun mount 200 may be used independent of the swing mount 300 or with the swing mount 300 for a total of at least 6 different applications. The gun mount 200 shape is designed to be strong and light-weight, as well as for use with the maximum number of different weapons and applications. For example, as depicted in FIGS. 4 through 10, the gun mount omits material where reinforcement is unnecessary and includes additional material where necessary to provide strength and durability.

The gun mount 200 may include various apertures, including universal pintle adapter apertures 221, swing mount pivot point apertures 230, travel lock apertures 234, traverse and elevating mechanism apertures 238, forward and aft firearm attachment apertures 210, 212, ammunition container mounting apertures 282, and Picatinny rail adapter mounting apertures 261 adapted to accept a Picatinny rail adapter 260 for mounting a firearm that has a Picatinny rail such as the MK 46 Mod 1. The various apertures may include stainless half bushings 215 for use with ball lock pins 217 so that when a user is removing a pin from an aperture, the user may release the button on the pin and the pin will release the ball in the recess such that the ball pin will stop like a captive pin without having to use a captive pin. Alternatively, the user may continue to hold the button in and pull the pin all the way out of the aperture if desired.

The gun mount 200 may include a universal pintle adapter pivot point 220 incorporated into the design of the larger primary element of the gun mount wherein the UPA pivot point 220 is an aperture 221 disposed in the forward lower portion of the gun mount 200. This UPA pivot point 220 for mounting enables four different applications such that combination with the swing mount 300 may not be required. The next aperture may include a swing mount pivot point aperture 230 disposed on the lower portion of the gun mount aft of the UPA pivot point 220. The swing mount pivot point aperture 230 allows the swing mount to be mounted in combination with the gun mount 200. These apertures are universal for currently existing attachments.

The Picatinny rail adapter mounting apertures 261 may be disposed above the swing mount pivot point apertures 230 for receiving a bolt or pin to allow the Picatinny rail adapter 260 to pivot between approximately horizontal and approximately vertical positions. The traverse and elevating mechanism apertures 238 are disposed on the lower aft portion of gun mount 200. The travel lock arm apertures 234 are the next apertures forward of the traverse and elevating mounting apertures 238. The travel lock arm apertures 234 are for attachment of a travel lock arm 450 for stowing the gun mount 200 with the swing mount assembly 300. The combination of the traverse and elevating mechanism and the travel lock arm 450 comprise a dual combination system that is believed to be novel for a gun mount having the functional capability of both attachments in one gun mount.

The gun mount 200 may be a primary single element or it may include a Picatinny rail adapter 260 as a second element attached to the primary gun mount 200 element such that the Picatinny rail adapter 260 is incorporated into the gun mount 200. The Picatinny rail adapter 260 may also be stationary, removable, or rotate from the aft forward and upward 90 degrees, from horizontal to vertical, for holding up a MK 46 Mod 1, as a sixth application or a sixth firearm, which gives the gun mount even more versatility. The Picatinny rail adapter 260 may be a block that rotates up and attaches to the bottom of a Picatinny rail on a given firearm, thus providing a unique way to mount such firearms as the Mk 46 Mod 1. The MK 46 Mod 1 originally did not require a gun mount. However, there is now a need and a demand for a MK 46 Mod 1 gun mount and a special adapter for mounting the MK 46 Mod 1 using the firearm's Picatinny rail.

Figure 6:
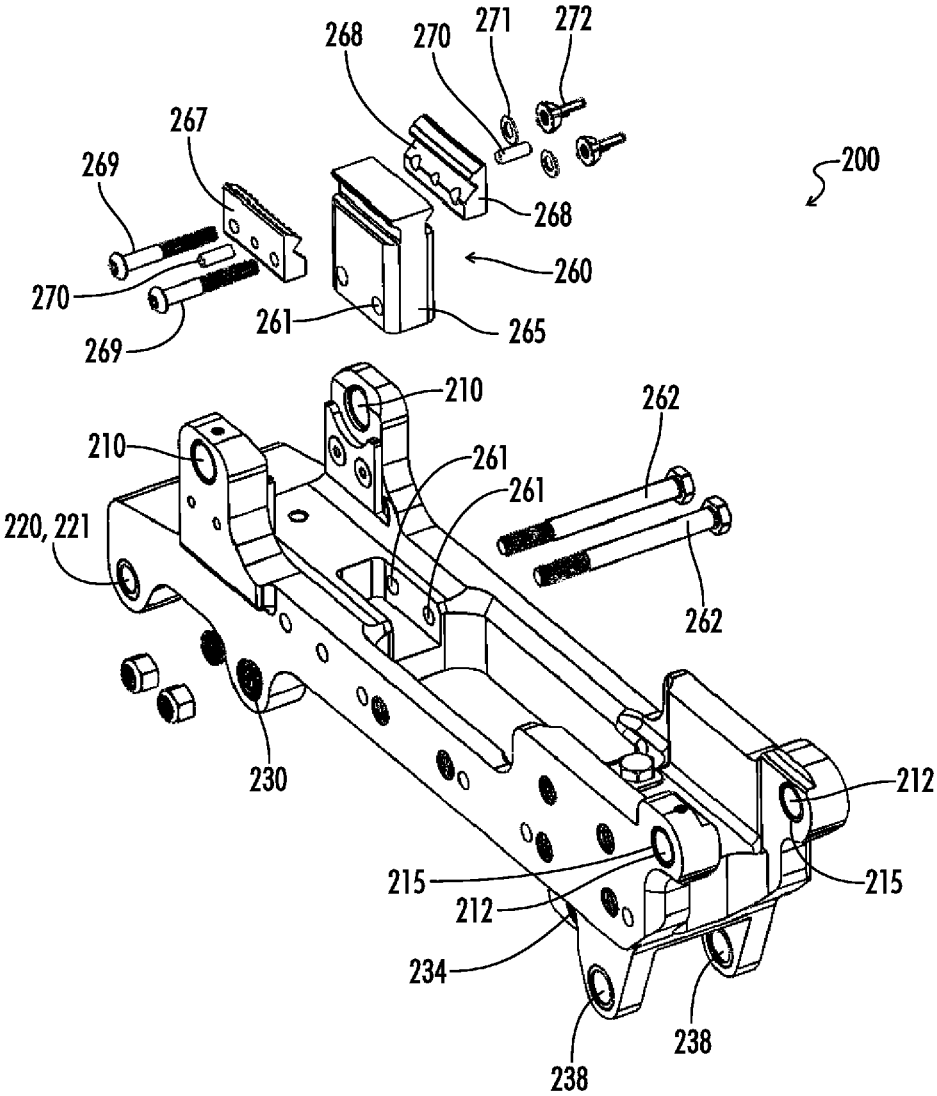
FIG. 6 is an exploded view of another embodiment of a gun mount assembly with a Picatinny rail adapter.
Figure 7A:
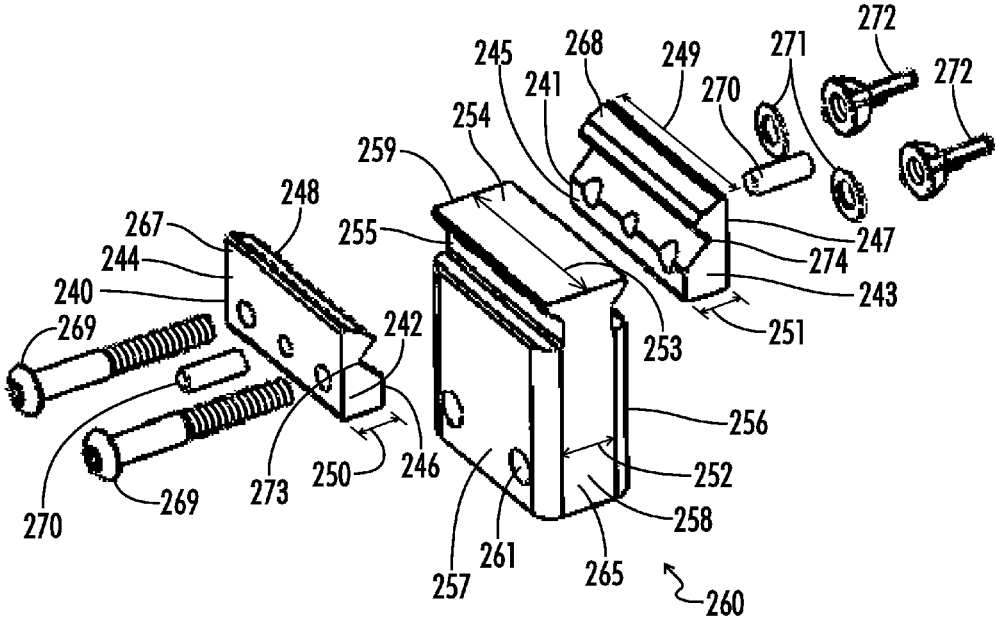
FIG. 7A is an exploded view of a Picatinny rail adapter.
Figure 7B:
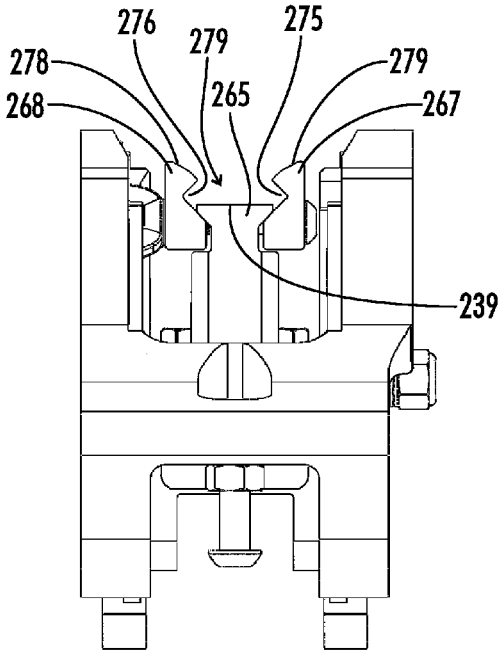
FIG. 7B is a front view of one embodiment of a gun mount assembly with a Picatinny rail adapter.
Figure 8:
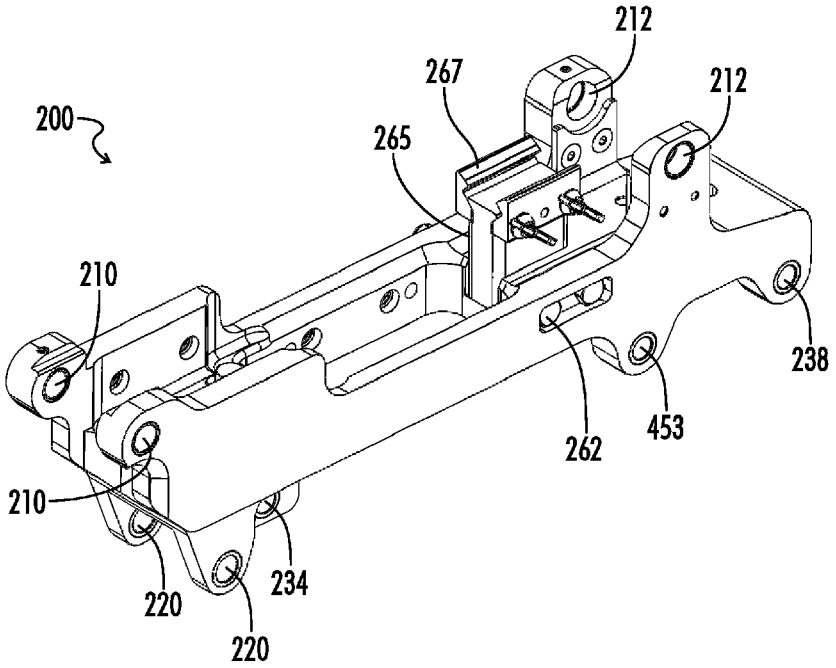
FIG. 8 is an isometric of FIG. 7B.
Figure 9:
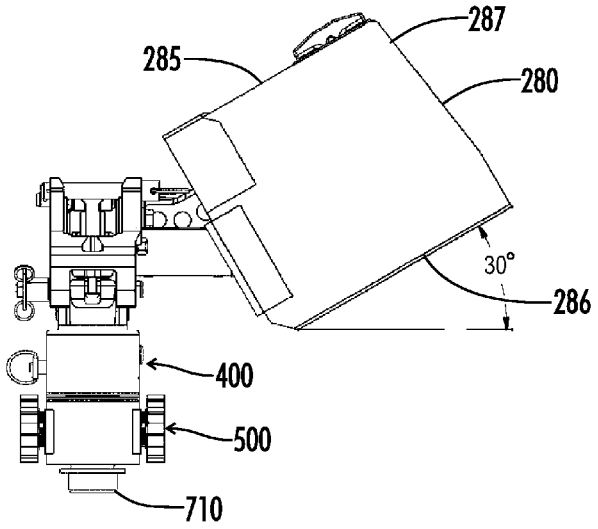
FIG. 9 is a front view of one embodiment of a gun mount assembly with an angled ammunition container.

As shown in FIGS. 6 through 8, the Picatinny rail adapter may include a swivel means such as a pin swivel aperture 261 above the swing mount pivot point aperture 230 and a fastener 262 or pin for Picatinny rail adapter rotation. Another embodiment for the Picatinny rail adapter 260 may include a center block 265 with gun mount apertures 261, a right plate 268, a left plate 267, and Picatinny rail assembly fasteners 269, 270, 271, 272 for attaching the left and right plate 267, 268 with the center block 265. Optionally, one or more of the fasteners 269, 270, 271, 272 is a wing nut. The fasteners 262 may pass through the apertures 261 to secure the Picatinny rail adapter 260 with the gun mount 200.

The Picatinny rail assembly 260 comprises a center block 265 that includes a forward end 259, an aft end 258, a block length 253 extending from the forward end 259 to the aft end 258, left and right sides 257, 256, a block width 252 extending from the left side 257 to the right side 256, a substantially flat top 254, and recesses 255 in the left and right left sides 257, 256, the recesses extending substantially the entire length 253 of the block 265; a left plate 267 that includes a forward end 240, an aft end 242, a length 248 extending from the forward end 240 to the aft end 242, a left side 244, a right side 246 configured to face the block 265, a width 250 extending from the left side 244 to the right side 246 of the left plate 267, a substantially v-shaped recess 273 in the right side 246 of the left plate 267 and extending substantially the entire length 248 of the left plate 267; a right plate 268 that includes a forward end 241, an aft end 243, a length 249 extending from the forward end 241 to the aft end 243, a left side 245 configured to face the block 265, a right side 247, a width 251 extending from the left side 245 to the right side 247, a substantially v-shaped recess 274 in the left side 245 of the right plate 268 and extending substantially the entire length 249 of the right plate 268; and fasteners 269, 270, 271, 272 for attaching the left and the right plates 267, 268 to the block 265, wherein when the left and right plates 267, 268 are attached to the block 265 by the fasteners 269, 270, 271, 272, the assembly comprises a Picatinny recess 279, which has a floor 239 defined by the top of the block 254, a left side 275 defined by the left plate 267, and a right side 276 defined by the right plate 268.

In some embodiments, the left plate 267 has a top surface 279 situated above the top surface 254 of said block 265 in which the height of the left plate top surface 279 is greatest at the left side 244 of said left plate top surface and is lowest at the right side 246 of said left plate top surface, and said right plate 268 has a top surface 278 situated above the top surface 254 of said block 265, said right plate top surface 278 having a height that is greatest at the right side 247 of said right plate top surface and is lowest at the left side 245 of said right plate top surface. See FIGS. 7A and 7B.

The ammunition container 280 and gun mount assembly 200 may comprise a gun mount 200 configured to hold a firearm 10. In such embodiments, as shown for example in FIGS. 9 and 10, the gun mount 200 may include a forward end 201, an aft end 202, a gun mount length 206 extending from the forward end 201 to the aft end 202, a left side 203, a right side 204, and a gun mount width 205 extending from the left side 203 to the right side 204, the gun mount width 205 being shorter than the gun mount length 206; and an ammunition container 280 configured to feed ammunition to a firearm 10 mounted in the gun mount 200, the ammunition container 280 mounted to the left side 203 or the right side 204 of the gun mount 200, the ammunition container 280 comprising a top side facing the sky, the top side 285 disposed at an angle of between about 15 degrees and about 45 degrees (preferably about 30 degrees) relative to the ground, the top side 285 comprising a feed opening 291 for feeding ammunition from the ammunition container 280 into the firearm 10; a bottom side 286 opposite the top side 285 and facing the ground; an interior side 288 facing the gun mount 200; and an exterior side 287 opposite the interior side 288 and facing away from the gun mount 200.

Figure 3:
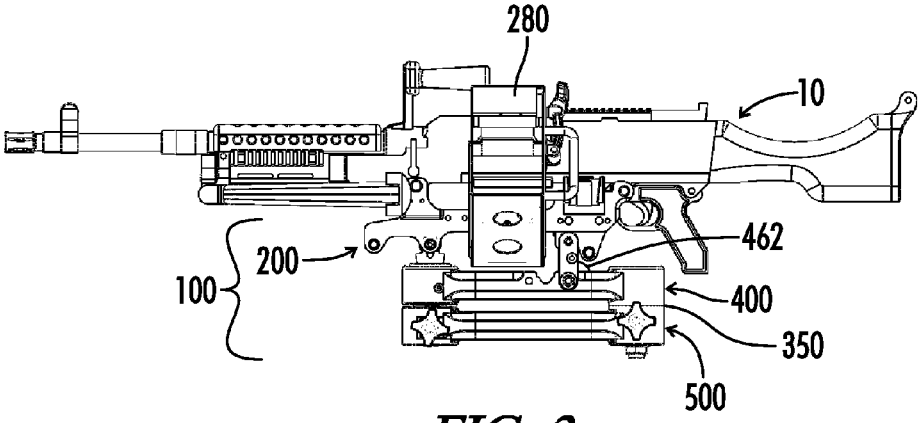
FIG. 3 is a left side view of FIG. 1.
Figure 4:
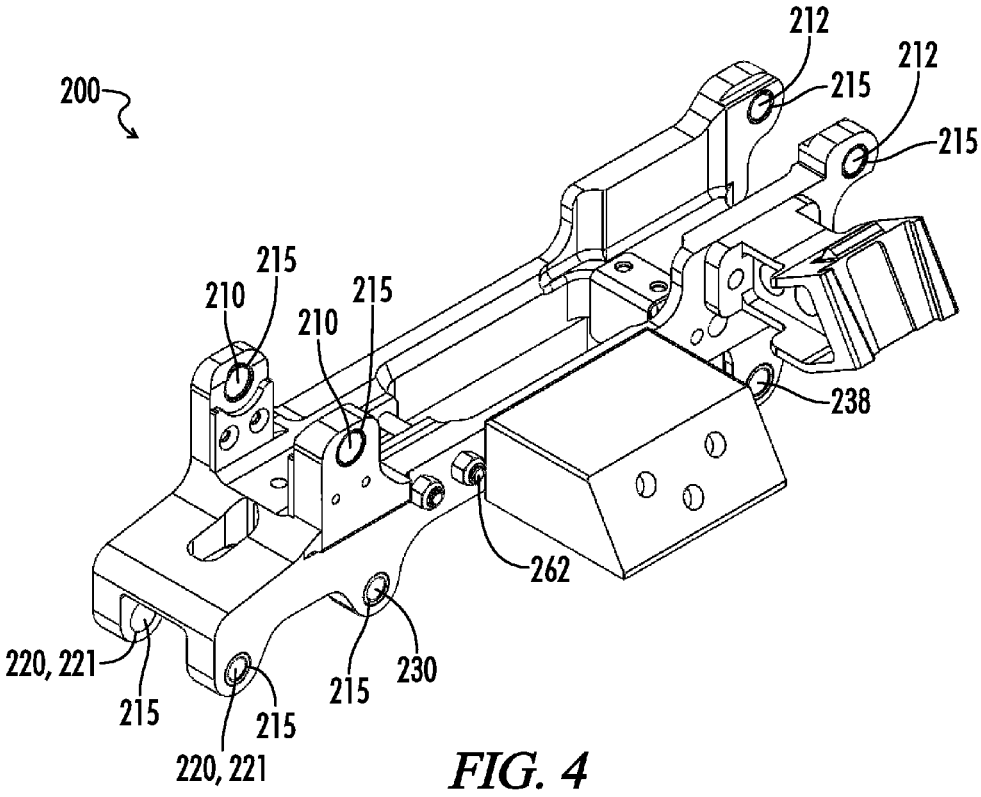
FIG. 4 is an isometric of one embodiment of a gun mount assembly without an ammunition container.
Figure 5:
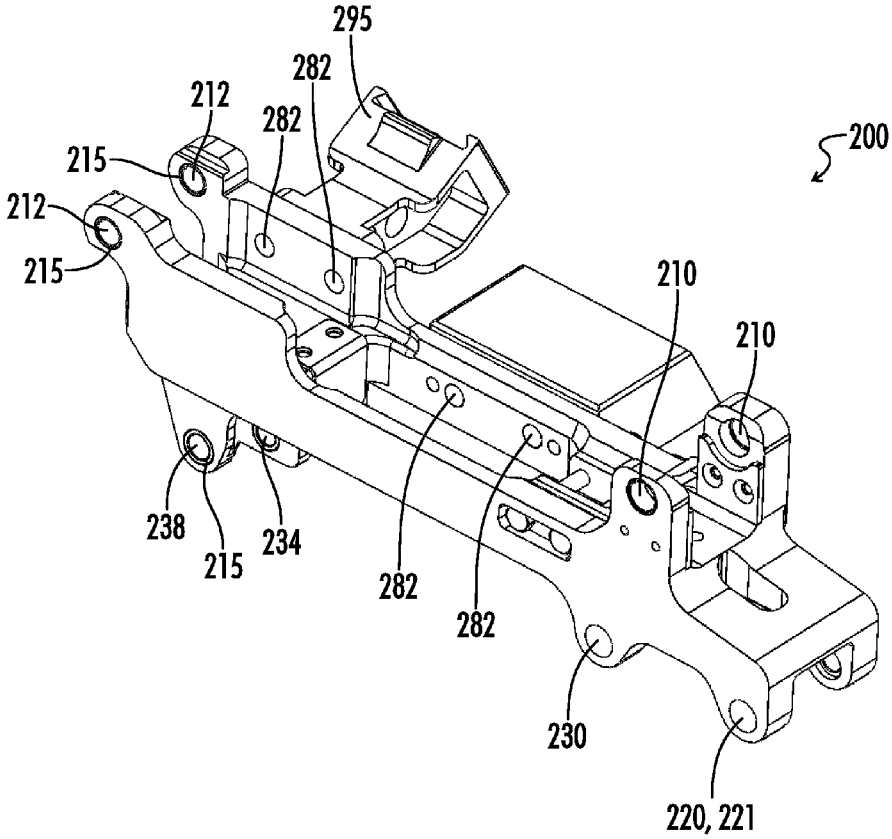
FIG. 5 is another isometric of an embodiment of a gun mount assembly.

As shown in FIG. 3, for example, the ammunition container 280 is mounted with the gun mount 200 using the ammunition container mounting apertures 282 disposed on the left side 203 of the gun mount 200. The ammunition container mounting apertures 282 may be disposed between the swing mount pivot point 230 and the travel lock arm stowage aperture 234 such that the ammunition container mounting apertures 282 are aligned forward and aft with the location needed for proper feeding of the ammunition. The apertures 282 are universal.

Multiple types of ammunition containers 280 may be used with the gun mount 200. For example, the gun mount 200 may also use ammunition containers 280 that are disposed at the aft 202 of the gun mount 200 and tilted upward and mounted in an upper position or a lower position. With the multiple apertures, an Mk 48 mod 0 firearm may use several different fabric "soft pack" magazines. The soft packs may be used with the current clip 295, thus allowing the ammunition container 280 movement aftwards and forwards and still maintain compatibility to accommodate several different firearms.

Figure 10:
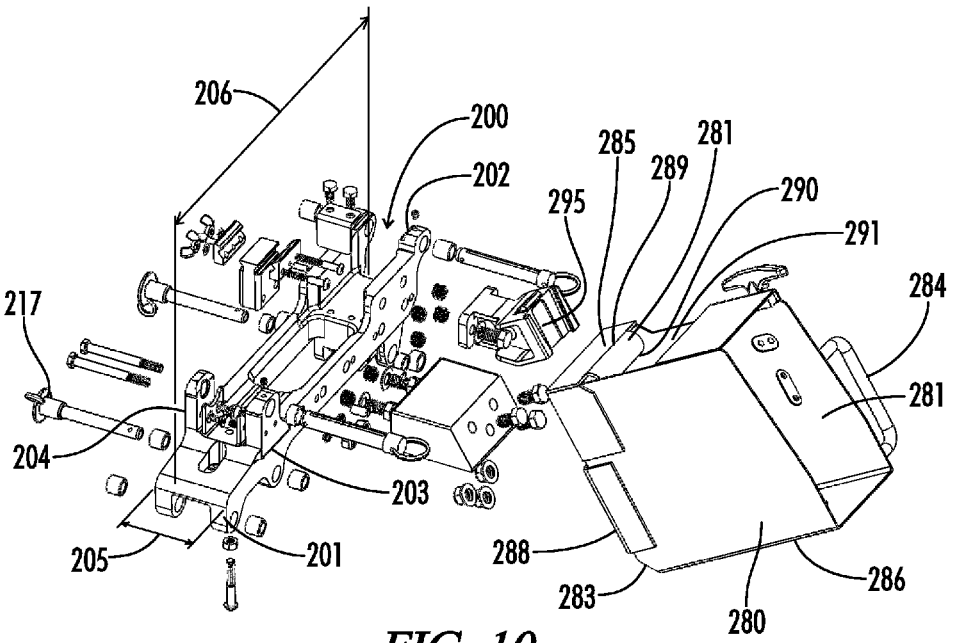
FIG. 10 is an exploded view of an embodiment of a gun mount assembly with an ammunition container.
Figure 11:
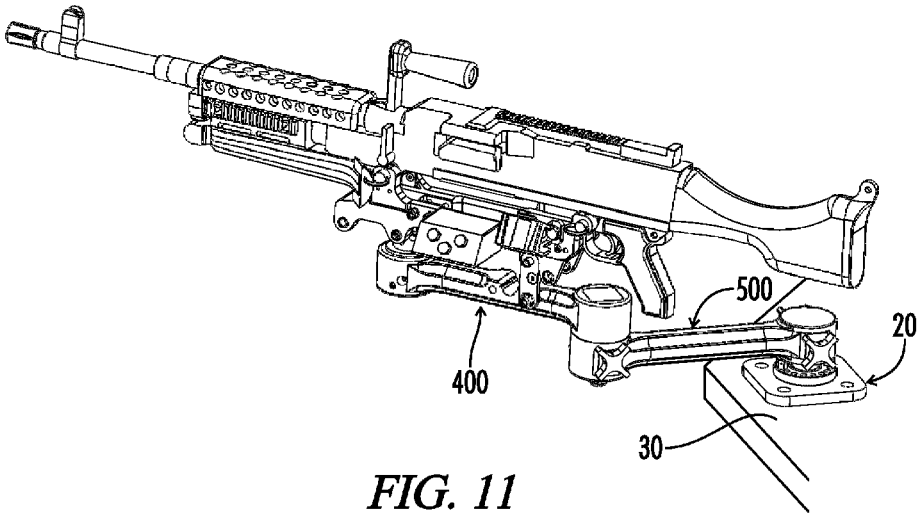
FIG. 11 is an isometric of another embodiment of a weapon mounting system.

The gun mount 200 may use ammunition containers 280 that are installed on the gun mount 200 at an angle of approximately 30 degrees from the ground, which gives the ammunition container 280 a lower profile. The interior 288 and bottom side 286 of the ammunition container 280 may meet at a lower edge 283 and form an angle of greater than about 90 degrees, as shown in FIG. 10, to provide more clearance and provide a lower profile. By rotating the ammunition containers upward, the gun mount 200 may be lowered considerably in relation to a swing mount 300 or other mounting applications. In addition, the rotated orientation and low profile of the ammunition container 280 provides the proper alignment for vertically feeding of the ammunition directly down into the firearm 10 without requiring the ammunition to travel up over one side of the ammunition container 280 and then back down into the firearm 10, thereby reducing wear and jamming. The ammunition container 280 and clips 295 are different components that are light-weight and less expensive to build than the prior art. The present ammunition container 280 reduces the profile by about 1 inch, whereas previous ammunition containers were taller and longer. The ammunition container 280 allows for different locations for mounting apertures 282. The mounting apertures 282 may only be included on the left side 203 of the gun mount 200.

The top side 285 of the ammunition container and gun mount assembly may include a lip 281, wherein the lip 281 includes a lip apex 289 extending towards the sky and a lip base 290 extending into the feed opening 291. In one embodiment, the assembly may include a firearm 10 attached to the gun mount 200, and the firearm 10 may have a firearm housing 11 and a firearm load opening 12 for loading ammunition into the firearm housing 11, and the lip 281 may be configured to feed an ammunition clip into the load opening 12 at an angle of between about negative fifteen degrees and about positive fifteen degrees relative to the ground.

In another embodiment, the assembly may include a firearm 10 attached to the gun mount 200 wherein the firearm 10 includes a firearm housing 11 and a load opening 12 for loading ammunition into the firearm housing 11, and further wherein the lip apex 289 is lower than the load opening 12. The ammunition container and gun mount assembly may include a bottom side 286 disposed at an angle of between about 15 degrees and about 45 degrees relative to the ground. The ammunition container 280 may also include a handle 284. The assembly may also include an open exterior side 287. The assembly may include the gun mount 200 including a plurality of apertures 282 along the gun mount length 206 for mounting the ammunition container 280 to the gun mount 200 at a plurality of locations along the gun mount length 206. The gun mount 200 may use 200, 100, and 50 round soft pack magazines and may use clips. The mounting apertures 282 used depend on the firearm or application selected.

In another embodiment, the gun mount uses three sets of holes with a first set of apertures above and between the swing mount pivot point 230 and the T & E apertures 238. The second and third sets of apertures may be disposed above the T & E apertures 238 and the travel lock apertures 234. The apertures 282 for the ammunition containers 280 and clips 295 result in versatility for different ammunition containers and different firearms including the Mk 48 mod 0. The ammunition container works with various firearms, including the M46, 240B, 249SAW, Mag 58, and MK 48 mod 0. The front feed ammunition containers are for the 240B and the Mag 58, while the aft feed ammunition containers are for the Mk 46, 249, Mk48, ammunition container, assault packs slide down the slot, metal retainer, and snap into place. The Mk48 is a light-weight 240B machine gun that feeds in the back like the Mk46 and the 249SAW. If using only 200 round ammunition cans and not assault packs the user is able to take the can and move it to the aft and move the clip forward and re-bolt to the front so that the added lower two holes may be used for proper feeding on machine guns 10. The clips are interchangeable and can be installed in a variety of locations. They have approximately a 60 degree angle.

Swing Mount 300:

As illustrated in FIGS. 1 through 3, 9, and 11 through 19, the swing mount 300 may comprise a double articulating arm means for attaching a gun mount 200 with a mounting bracket 20. In one embodiment, the arm assembly for a firearm may comprise an arm that includes a pintle housing 520 and 530 wherein the arm pintle housing includes an interior 502 having a socket and an exterior 503; a pintle 720 disposed in the socket wherein the pintle includes a pintle circumference 725 and may include a groove 724 that extends around the circumference at a first pintle height 726 and a plurality of substantially circular recesses 612 disposed about the circumference at a second pintle height 727; a first rotatable adjustment knob 602 attached to the pintle housing 520 and 530 and rotatable relative to the pintle housing; a second rotatable adjustment knob 602 attached to the pintle housing 520 and rotatable relative to the pintle housing; a locking pin 610 operably connected to the first adjustment knob, wherein rotation of the first adjustment knob causes the locking pin 610 to engage a substantially circular recess 612 in the pintle and inhibit the pintle from rotating in the socket; and a moveable collar 650 comprising a tongue 526, said moveable collar operably connected to the second adjustment knob, wherein rotation of the second adjustment knob causes said tongue to engage the groove 724 in the pintle and inhibit the pintle from retracting from the socket and rotating in the socket. The pintle circumference 725 may or may not be variable along the pintle 720 depending on whether the pintle 720 is cylindrical. Different embodiments may comprise one or more of the following: the arm assembly may include the arm connected to a gun mount 200 configured to hold a firearm 10; the arm assembly may comprise two arms 410, 510, each arm rotatably connected to each other via the pintle 720. Optionally, the pintle 720 is generally cylindrical as shown in FIG. 12.

The swing mount 300 may comprise a first swing arm assembly 400, a second swing arm assembly 500, a gun mount pintle 710 with ball lock pin 712, a mounting bracket pintle 720, and an approximately square head aft pivot point pintle 730. The swing mount 300 has aft knuckles 430, 530 stacked one on top of the other wherein the second swing arm aft knuckle 530 rotates to form a pivot point for the swing mount 300 at the aft of the first and second swing arm assemblies 400, 500. The swing mount first swing arm assembly 400 and the second swing arm assembly 500 have forward knuckles 420, 520 that receive pintles 710, 720 for attaching the swing mount to the gun mount 200 and the mounting bracket 20, respectively.

First Swing Arm Assembly 400:

The first swing arm assembly 400 comprises a first swing arm 410, a forward knuckle 420 with a gun mount pintle socket 422, an aft knuckle 430 with an aft pivot point pintle socket 432, and a travel lock assembly 450. The gun mount pintle socket 422 is the forward portion of the first swing arm 410 where the gun mount pintle socket 422 attaches with gun mount pintle 710 that attaches with the gun mount 200. The gun mount pintle socket 422 allows for rotation of the gun mount 200 and the firearm 10 about one axis. The gun mount pintle 710 and the gun mount pintle socket 422 do not lock so that gun mount 200 and first swing arm assembly 400 may rotate horizontally and independently of each other.

The first swing arm assembly 400 may include a travel lock arm assembly 450 to secure the gun mount 200 in a stowage position configuration. The travel lock assembly 450 may include a first and second arm 451, 452 each having a pivot aperture 453 and a gun mount aperture 460. A travel lock pivot bolt 454 inserted through the first arm travel lock apertures 457 and the pivot apertures 453 may also be included along with a gun mount 200 configured to receive a firearm 10.

The gun mount 200 may have a pair of gun mount travel lock apertures 234; wherein the first and second travel lock arms 451, 452 include a storage position where the travel lock arms 451, 452 are substantially parallel to the first arm 410, and a travel lock position where that the travel lock arms are at an angle 462 of at least 30 degrees (e.g., about 90 degrees) relative to the first swing arm 410. As shown in FIG. 3, the travel lock arms 451, 452 are in the travel lock position and the travel lock arms are at an angle 462 of about 90 degrees relative to the first swing arm 410.

In another embodiment the travel lock assembly may further include first and second travel lock arms in the travel lock position and a travel lock pin 456 may be removably inserted through the gun mount apertures 460 in the travel lock arms and through the gun mount travel lock apertures 234. The travel lock assembly may further include a travel lock brace 458 extending from the first second travel lock arm to the second travel lock arm.

The travel lock assembly may also include the first arm having a top surface 411 facing the gun mount 200 and an opposing bottom surface 412 and the top surface may comprise a travel lock brace recess 459 for receiving the travel lock brace 458 when the first and second travel lock arms are in the storage position. The travel lock arm assembly 450 may include a travel lock arm 451, 452, a travel lock bolt 454, and a gun mount travel lock ball lock pin 456 wherein the travel lock arm assembly comprises dual support arms 451, 452 and a brace 458 between the arms 451, 452.

The travel lock arm 451, 452 may be secured to the first swing arm 410 with a travel lock bolt 454 wherein the travel lock assembly 450 rotates up and aftward on the first swing arm 410 such that the travel lock arms 452 apertures 453 mate with the gun mount travel lock apertures 234 where the gun mount 200 and the travel lock arms 451, 452 attach with a travel lock ball lock pin 456. With the gun mount 200 and the travel lock arms 451, 452 attached, the gun mount 200 is locked with the first swing arm 410 in the travel lock or stowage configuration. When the travel lock arm is not attached with the gun mount, the forward and aft portion of the travel lock arms 451, 452 are secured with the first swing arm 410 with travel lock bolt 454 and the gun mount travel lock ball lock pin 456 and the gun mount 200 has another degree of freedom. The gun mount 200 may rotate in one axis when the travel lock arm 451, 452 is secured with the gun mount. When gun mount 200 is not secured with the travel lock arm 451, 452 (i.e., when the travel lock arms are in the storage position), the additional elevation and depression axis creates two additional axes of movement.

The first swing arm assembly travel lock assembly 450 uses a dual travel lock arm 451, 452 combination that secures the gun mount 200 on both sides of the gun mount 200 and creates less vibration in the gun mount 200. The first swing arm 300 has a travel lock brace recess 459 in the first swing arm 410 for the brace 458 between the two travel lock support arms 451, 452. Previously only one arm or lever has been used for a travel lock that rotates. The travel lock height and the gun mount pintle height are dependent upon the ammunition container clearance with the first swing arm assembly 400. With the angled low profile ammunition container of this invention, the gun mount pintle 710 and the travel lock assembly 450 may have a lower profile for the weapons mounting system 100.

The first swing arm aft pivot point pintle socket 432 includes an approximately square cutout or slot 434 that receives the approximately square head 436 aft pivot point pintle 730. The top of the aft approximately square head 436 aft pivot point pintle 730 mates with the approximately square cutout 434 in the first swing arm aft pivot point pintle socket 432 to prevent the aft pivot point pintle 730 from turning in relation to the first swing arm 300. The aft portion 430 of the first swing arm 410 and the aft portion 530 of the second swing arm 510 create a joint swing arm pivot point 350 where the first swing arm aft knuckle 430 is disposed over the second swing arm assembly aft knuckle 530. The joint swing arm pivot point 350 includes the approximately square head 436 aft pivot point pintle 730 that is inserted through and is secured with the approximately square cutout 434 in the first swing arm aft pivot point socket 432 wherein the approximately square head 436 aft pivot point pintle 730 is inserted through the approximately square cutout 434 in the first swing arm aft pivot point socket 432 as well as attaches the second swing arm 510 with the first swing arm 410 and secures the first swing arm 410 with the aft pivot point pintle 730 such that only the second swing arm aft knob locking systems 670, 680 are required for tightening and loosening the joint swing arm pivot point 350 since the approximately square head 436 aft pivot point pintle 730 is locked with the first swing arm 410.

Second Swing Arm Assembly 500:

The second swing arm assembly 500 may comprise a second swing arm 510, a forward knuckle with a mounting bracket pintle socket assembly 520, and an aft knuckle with an aft pivot point pintle socket assembly 530. The second swing arm 510 connects the mounting bracket socket assembly 520 with the opposing aft pivot point socket assembly 530. The mounting bracket socket assembly 520 includes a knob mounting bracket socket positive locking system 620, and a knob mounting bracket socket friction locking system 630 and the opposing second swing arm aft pivot point socket assembly 530 includes a knob aft pivot point socket positive locking system 670, and a knob second swing arm aft pivot point socket friction locking system 680.

As shown in FIG. 12, the mounting bracket pintle socket assembly 520 may comprise a mounting bracket pintle socket 522, a recessed support area 523 for the foot of the mounting bracket pintle post 722, a support washer 524 for the mounting bracket pintle post 722, an internal positive locking system 620 with a retainer collar tongue 526, an internal friction locking system 630 with a retainer collar tongue 526, and the mounting bracket pintle post 722 includes a matching groove retainer portion 724 that extends around the circumference 725 of the pintle. The mounting bracket pintle post retainer matching groove 724 matches with the internal positive locking system retainer collar tongue 526 and the internal friction locking system retainer collar tongue 526 to securely retain the mounting bracket pintle post 722 within the mounting bracket pintle post socket 522 except when the internal positive locking system 620 retainer collar tongue 526, and the internal friction locking system 630 retainer collar tongue 526 are fully open.

The mounting bracket pintle socket 522 is disposed in the forward knuckle in the forward portion of the second swing arm 510 wherein the mounting bracket pintle socket assembly 520 attaches with a mounting bracket pintle post 722. The mounting bracket pintle post 722 attaches with the mounting bracket 20 of the vehicle or fixture 30 where the firearm 10 is to be installed. The mounting bracket pintle post 722 is disposed within the mounting bracket pintle socket 522 and the recessed support area 523 for the foot of the mounting bracket pintle post 722 and the support washer 524 for the mounting bracket pintle post 722 inhibit side to side movement (i.e., play) by the mounting bracket pintle post 722 within the socket 732. However, the mounting bracket pintle post 722 may rotate when the internal friction lock 630 and the internal positive lock 520 are open and so as to allow rotation of the pintle post 722 within the socket 732. The mounting bracket pintle post 722 is the singular area that connects the weapon mounting system for firearms 100 with the vehicle or fixture 30.

As shown in FIGS. 2 and 12, the second swing arm aft pivot point pintle socket assembly 530 is disposed on the second swing arm 510 opposing the mounting bracket pintle socket assembly 520. The second swing arm aft pivot point pintle assembly 530 may include an aft pivot point pintle socket 532, a perforated washer 534, a solid support washer 535 for the aft pivot point pintle post 732, a knob positive locking system 670, a knob friction locking system 680, a lower washer 536, and an aft pivot point pintle post securing nut 537. The perforated washer 534 may include graphite to aid in lubricating the joint and may be disposed above the lower washer 536 and the aft pivot point pintle post securing nut 537.

The aft pivot point pintle 730 attaches the second swing arm aft pivot point pintle socket assembly 532 to the first swing arm aft pivot point pintle socket 432. The aft pivot point pintle post 732 is disposed within the second swing arm aft pivot point pintle socket assembly 530 and the aft pivot point pintle post 732 is secured from side to side movement by the solid support washer 535 above the knob positive locking system 670 and the knob friction locking system 680, and the aft pivot point pintle post 732 is secured from side to side movement below the knob positive locking system 670 and the knob friction locking system 680 by the lower washer 536 and the aft pivot point pintle post securing nut 537 such that the aft pivot point pintle post 732 is secured from side to side movement. However, the aft pivot point pintle post 732 may rotate when the internal friction lock 680 and the internal positive lock 670 are open and allow rotation of the aft pivot point pintle post 732 in the second swing arm aft pivot point pintle socket 532. The approximately square cutout 434 above and the lower washer 536 and the securing nut 537 below eliminate the need for the retainer tongue 526 and the pintle post matching groove 724 needed with the mounting bracket socket assembly 520. The aft pivot point pintle 730 is the singular area that connects the second swing arm 510 with the first swing arm 410.

As previously mentioned, the joint swing arm pivot point 350 includes the approximately square head 436 aft pivot point pintle 730 that is inserted through and is secured with the approximately square cutout 434 in the first swing arm aft pivot point socket 432 wherein the approximately square head 436 aft pivot point pintle 730 is inserted through the approximately square cutout 434 in the first swing arm aft pivot point socket 432 as well as attaches the second swing arm 510 with the first swing arm 410 and secures the first swing arm 410 with the aft pivot point pintle 730 such that only the second swing arm aft knob locking systems 670, 680 are required for tightening and loosening the joint swing arm pivot point 350 since the approximately square head 436 aft pivot point pintle 730 is locked with the first swing arm 410.

Knob Locking Assembly 600

The forward pintle system and the aft pintle system for the second swing arm assembly 500 may include a knob locking system 600 comprising a knob positive locking 620, 670 and a knob friction locking 630, 680 assembly.

In some embodiments, for example, as shown in FIGS. 2, 12 and 17 through 19, the knob locking assembly includes a pintle housing 520, 530, the pintle housing having an interior 502 comprising a socket 432, 532 and an exterior 503; a rotatable adjustment knob 602 attached to said pintle housing 520, 530 and rotatable relative to said pintle housing 520, 530, the rotatable adjustment knob 602 having an interior surface 601 facing the pintle housing and an opposing exterior surface 603; a disk 606 having a circumference 609 and a plurality of cuts or valleys 607 and ridges or teeth 608 disposed about said circumference 609, said disk 606 situated between said pintle housing 520, 530 and said rotatable adjustment knob 602; and a disk pin 604 attached to said knob interior surface 601, said disk pin 604 engaging said valley 607 in said disk 606, wherein rotation of said rotatable adjustment knob relative to said pintle housing 520, 530 causes said disk pin 604 to rotate relative to said pintle housing 520, 530 and disengage from said valley 607 and engage another valley 607 in said disk 606.

Optionally, the knob locking assembly further includes a pintle 720, 730 disposed in said socket 432, 532, said pintle 720, 730 having a pintle circumference 725 and a plurality of substantially circular recesses 612 disposed about said circumference; and a locking pin 610 operably connected to said rotatable adjustment knob 602, wherein rotation of said rotatable adjustment knob causes said locking pin 610 to engage a substantially circular recess 612 in said pintle and inhibit said pintle from rotating in said socket, as shown in FIGS. 13 through 16.

Optionally, the knob locking assembly further includes: a pintle 720 disposed in said socket, said pintle having a circumference 725 and a groove 724 that extends around said circumference; and a moveable collar 650 comprising a tongue operably connected to said rotatable adjustment knob, wherein rotation of said rotatable adjustment knob 602 causes said tongue to engage said groove 724 in said pintle 720 and inhibit said pintle from retracting from said socket.

Optionally, the pintle 730, 732 is connected to the gun mount 200 through the swing arm assembly 300.

Figure 13:
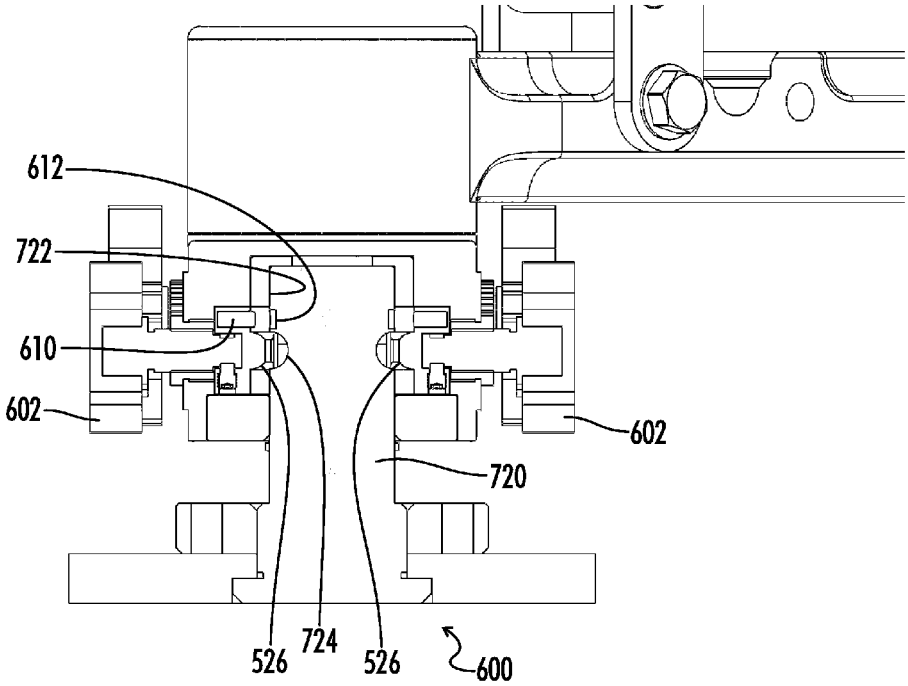
FIG. 13 is a cutaway view of one embodiment of a second forward swing arm knob locking assembly in the open position.
Figure 14:
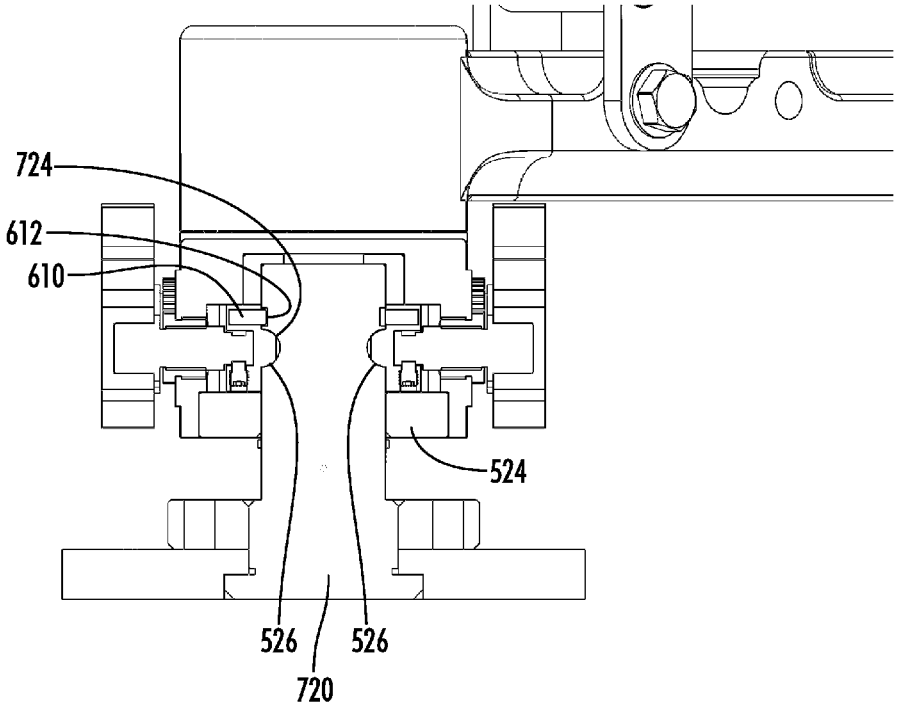
FIG. 14 is a cutaway view of another embodiment of a second forward swing arm knob locking assembly in the positive locked closed position.
Figure 15:
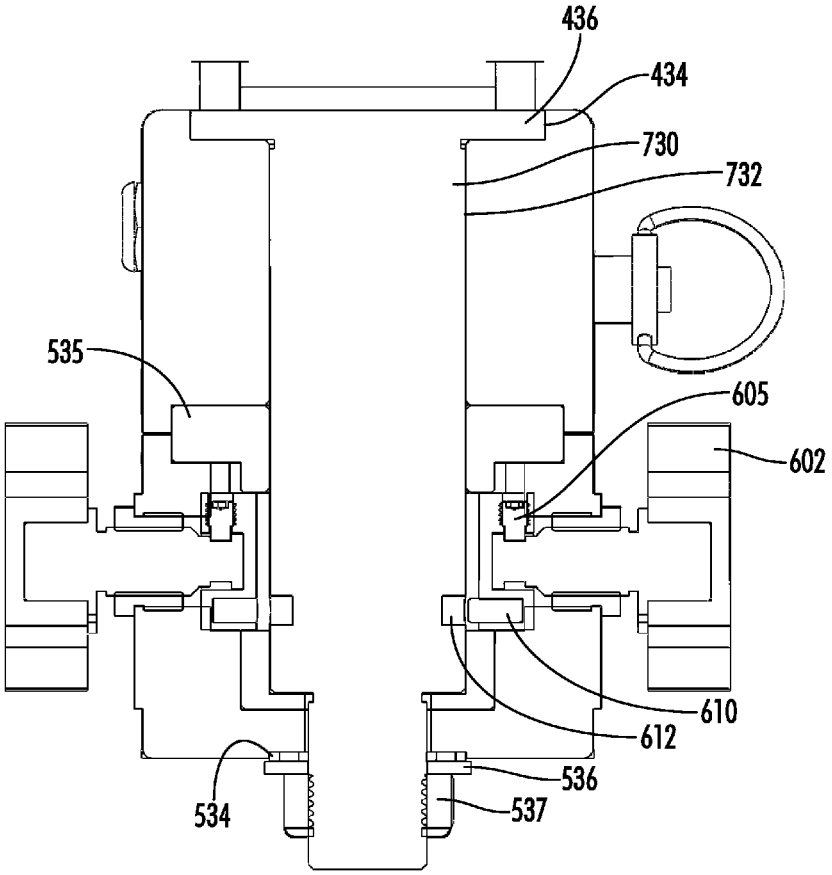
FIG. 15 is a cutaway view of one embodiment of a second aft swing arm locking assembly in the open position.
Figure 16:
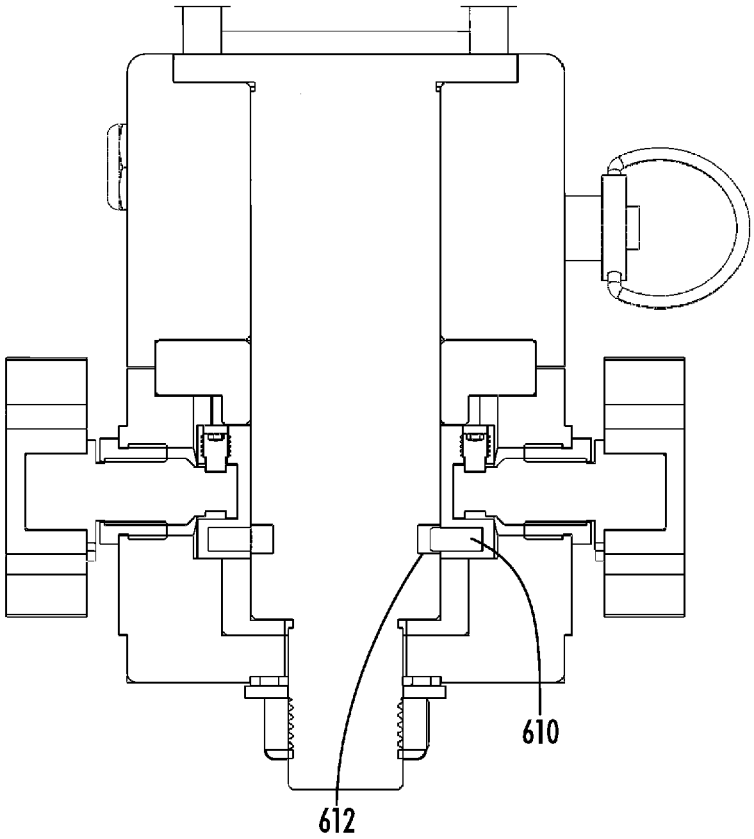
FIG. 16 is a cutaway view of one embodiment of a second aft swing arm locking assembly in the closed position.
Figure 17:
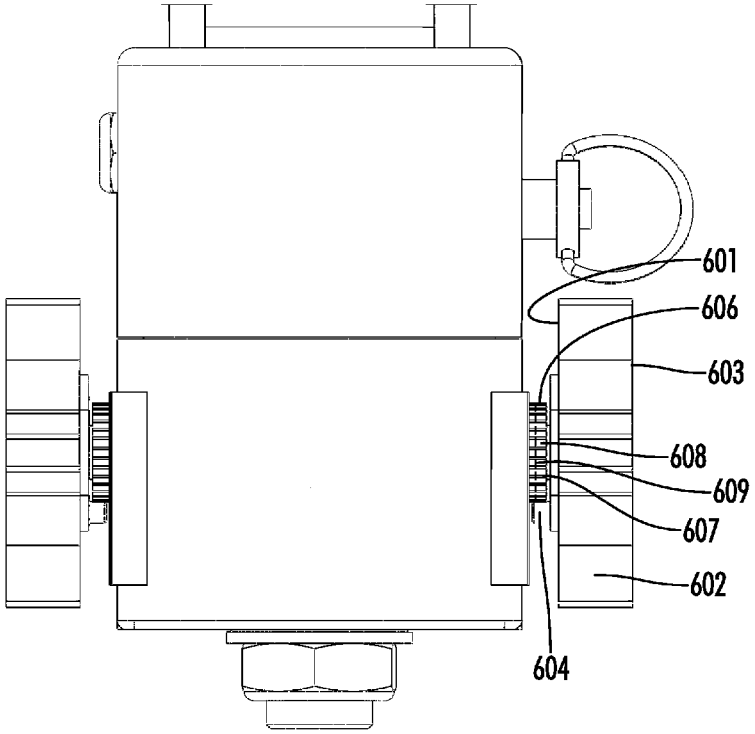
FIG. 17 is a front view of one embodiment of a second swing arm knob locking system.
Figure 18:
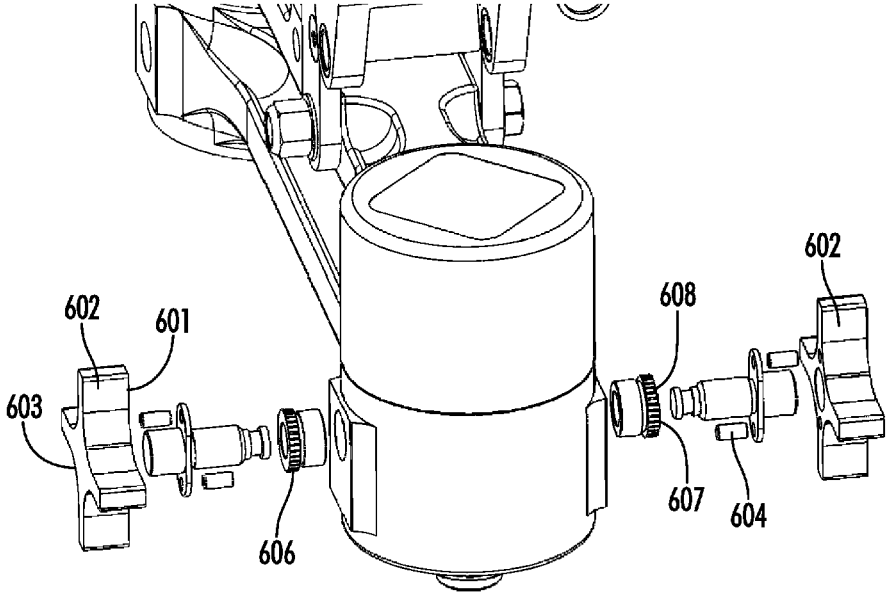
FIG. 18 is an exploded view of one embodiment of a second swing arm knob locking system.
Figure 19:
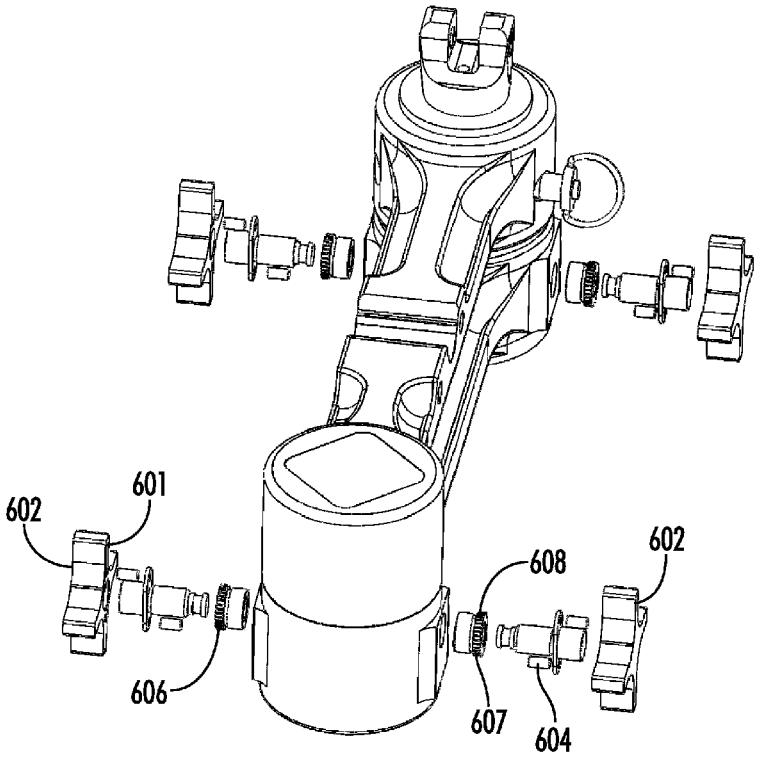
FIG. 19 is an exploded view of one embodiment of second swing arm knob locking systems in relation to the first and second swing arm assembly.

More particularly, as shown, for example, in FIGS. 12 and 13, the knob locking system 600 comprises capture or retainer collars 650 disposed in the second swing arm pintle sockets 520, 530 that wrap around the second swing arm mounting bracket pintle post 722 as well as the second swing arm aft pivot point pintle post 732.

The second swing arm assembly 500 may comprise four rotatable adjustment knobs, one rotatable adjustment knob 602 for each pintle may be positive locking and one rotatable adjustment knob 602 for each pintle may be a friction locking system. The combination of a positive locking and friction locking system for each pintle forms a failsafe mechanism. Each rotatable adjustment knob 602 turns independently and each pair of rotatable adjustment knobs 602 for each pintle 720, 730 tightens in opposite directions. Rotatable adjustment knobs 602 tightening the pintle (i.e., reducing movement of the pintle by positive locking and friction locking by turning the knobs in opposite directions—i.e., turning one knob clockwise and the other counter-clockwise) in opposite directions reduce the chance of the pintles 730, 720 becoming loose and rotating unintentionally.

The knob locking system 600 has a disk 606 comprising cuts or valleys 607 and teeth or ridges 608 positioned around the circumference 609 and the cuts/valleys 607 and the teeth/ridges 608 are hardened and coated for durability and survivability. The rotatable adjustment knobs 602 include a disk pin 604 attached to the interior surface of the knob 603 and the disk pin 604 rotates with the knob 602 and moves about the ridges/teeth 608 and the cuts/valleys 607 as the rotatable adjustment knobs 602 rotate. Thus, the disk pin 604 moves from one cut/valley 607 to an adjacent ridge/tooth 608 and then to the next cut/valley 607 as the knob rotates. As the rotatable adjustment knob 602 is turned, the pintle post 722, 732 is tightened and at a predetermined point the disk pin 604 holds the pintle post 722, 732 in place. The disk pin 604 and ridges/teeth 608 adjacent to the valley/cut 607 keeps the rotatable adjustment knob 602 from backing out as the pintle post 722, 732 is tightened thus producing a friction locking system 630, 680. This is an improvement over the past system of using friction knobs that may be backed out with friction.

In addition to the friction/drag benefits, the knob locking system may include a positive audible system. The user can physically know when the user is turning the rotatable adjustment knob by hearing the clicks when the user turns the rotatable adjustment knob as the disk pin 604 moves about the cuts/valleys 607 and ridges/teeth 608 in the disk, creating an audible positive stop mechanism. As the rotatable adjustment knob 602 is turned and the disk pin 604 moves about the teeth/ridges 607 and the valleys/cuts 608 the system provides a clicking noise and the disk pin 604 keeps the internal positive locking knob 620, 670 as well as the friction locking knob 630, 680 from backing out under load from vehicle or firearm vibration. This feature helps with fine adjustments of slight changes.

The knob locking system 600 features include a low profile as well as a rapid open and a rapid close capability. Whereas past systems required three full turns to go from locked to unlocked, the present invention allows a user to rapidly move from unlocked, or opened, to locked, or closed, with only a half of a turn. This also allows users that prefer some amount of drag during operation to operate with intermediate friction positions between the locked and unlocked position.

The locking knob system 600 may be a knob friction locking system 630, 680 wherein turning the rotatable adjustment knob 602 applies pressure directly to the pintle post 722, 732 through the retaining collar 650. The knob friction locking system 630, 680 is designed such that as parts start to wear the user may turn the rotatable adjustment knob one more click for slightly more friction to compensate for the worn material. The rotatable adjustment knob 602 turns and applies direct pressure through the retaining collar 650 to the pintle socket 522, 532 for adjusting friction and thus the amount of drag or force required for turning the second swing arm in relation to the mounting bracket pintle socket 522 or the aft pivot point pintle socket 532. As the rotatable adjustment knobs 602 are turned, the gearing applies direct pressure on the retaining collar 650 tightening the retaining collar 650 around the pintle post 722, 732 from opposing directions. As previously mentioned, the retaining collar 650 for the mounting bracket pintle socket 522 retainer collar 650 has a tongue or ridge 526 that captures the pintle post matching groove 724 for extra security and to retain the mounting bracket pintle 720 within the socket except when the retaining collar's ridges 526 are completely retracted.

In addition, the locking knob system 600 may be an internal positive locking mechanism 620, 670 similar to the friction locking system 630, 680 of the mounting bracket pintle socket 522 and the aft pivot point pintle socket 532. However, the internal positive locking device 620, 670 has a locking pin 610 and cavity 612 system in addition to the friction system. The pintle post 722, 732 includes a series of substantially circular recesses or cavities 612 around the circumference 725 of the pintle post shaft wherein the recesses 612 are aligned with the internal positive locking pin 610 such that the locking pin 610 may be inserted in one of the recesses 612 around the circumference 725 of the pintle post shaft. The preferred number of recesses is twelve equally spaced recesses around the circumference and the preferred embodiment includes the internal positive locking knob 620, 670 on the left and the internal friction locking knob 630, 680 on the right for both of the second swing arm knuckles 420, 430.

If the user desires to positively lock the system so that it will not move under heavy forces or vibration, the second swing arm 510 is moved for locking pin 610 and recess 612 alignment and the rotatable adjustment knob is tightened to insert the locking pin into the recess. However, if the user desires to set a specific force to rotate the pintle and thus the gun mount, the positive lock rotatable adjustment knob is opened enough to remove the locking pin 610 from the substantially circular recess 612 and the friction rotatable adjustment knob may be set for the desired friction that results in a specific force to rotate the system. With the internal positive locking system pin 610 retracted, the knob turned all the way to the open position, and the friction locking system turned all the way to the open position, the pintle can freely rotate. The mounting bracket pintle 720 may be removed when both knobs are fully opened or refracted. Optionally, the knob locking system 600 further includes a set screw 605.

Disposing the rotatable adjustment knobs 602 on the knuckle portion 520, 530 of the second swing arm 510 instead of between the knuckles 520, 530 on the second swing arm allows pressure to be applied directly on the pintle post and not indirectly away from the pintle post. This will prevent the parts from breaking as easily. For example, even if one of the rotatable adjustment knobs were to break, which is very unlikely, the user would still have a backup with the extra knob. If a part were to break in the knuckle or pintle housing, the broken part can be retracted and removed by backing the broken part out of the pintle. If one knob locking system were to fail, a user may still lock it with the other knob locking system of the failsafe system. The second swing arm mounting bracket socket and the second swing arm pivot point pintle socket both have the knob positive locking system for one knob and the knob friction locking system for the other knob. Knob locking systems 600 are not necessary on the first swing arms because the gun mount pintle may be locked by the travel lock and the aft pivot point is locked by the approximately square cutout of the aft pivot point pintle socket mating with the approximately square head of the aft pivot point pintle.

The present weapon mounting system is backward and forward compatible with other prior art gun mounting system parts. The present design thus provides the added benefit of eliminating the need to purchase new equipment to use the invention with existing mounting system components. The present invention also provides greater versatility than prior art gun mounting systems by virtue of its ability to mount with many different guns and many different applications. The dynamics of incorporating all of these features into one weapon mounting system for firearms is novel.

Testing:

A swing mount 300 with normal wear was subjected to MIL-STD 810G testing for the composite wheeled vehicle portion of MIL-STD 810G, as described below.

In one such test, the first and second swing arms 410 and 510 were aligned so that the arms were parallel, with the first swing arm in front of the second swing arm. A block weighing 27 pounds was mounted in the gun mount 200 to simulate the weight of a firearm, a 19-pound block was mounted in the gun mount 200 to simulate the weight of 7.62 ammunition, and a 7-pound block was mounted in the gun mount to simulate the weight of 5.56 ammunition. The swing mount was locked with the positive locks. However, the friction locks were kept open. The swing mount was subjected to 5 G-Forces to 9-G Forces during the initial testing for six hours. This testing was performed to determine the stability and safety of the swing mount under low to medium loads. The swing mount was then subjected to 9 G-Forces to 18 G-Forces for twelve hours. The swing mount was then subjected to 18 G-Forces to 22.5 G-Forces for twelve hours. The swing mount was then subjected to 18 G-Forces to 22.5 G-Forces for six hours. At the conclusion of the tests, it was determined that the arms had moved only five degrees.

In another such test, the first and second swing arms 410 and 510 were aligned so that the arms were parallel, with the first swing arm in front of the second swing arm. A block weighing 27 pounds was mounted in the gun mount 200 to simulate the weight of a firearm, a 19-pound block was mounted in the gun mount 200 to simulate the weight of 7.62 ammunition, and a 7-pound block was mounted in the gun mount to simulate the weight of 5.56 ammunition. The swing mount was locked with the friction locks. However, the positive locks were kept open. The swing mount was subjected to the G-forces described for the time periods described above. At the conclusion of the tests, it was observed that the swing mount moved four inches, whereas the length of the first and second swing arms was 24 inches.

In another such test, the first and second swing arms 410 and 510 were aligned so that the arms were parallel, with the first swing arm in front of the second swing arm. A block weighing 27 pounds was mounted in the gun mount 200 to simulate the weight of a firearm, a 19-pound block was mounted in the gun mount 200 to simulate the weight of 7.62 ammunition, and a 7-pound block was mounted in the gun mount to simulate the weight of 5.56 ammunition. The swing mount was locked with the friction locks and the positive locks. The swing mount was subjected to the G forces described for the time periods described above. At the conclusion of the tests, it was observed that the swing mount moved only five degrees.

The swing mount was also subjected to 11 days of Cyclic Humidity, Salt Fog and Sand/Dust Testing according to MIL-STD 810G. Again, there were no failures to report and the sockets were determined to be exceptionally clean.

Having now described the invention in accordance with the requirements of the patent statutes, those skilled in the art will understand how to make changes and modifications to the disclosed embodiments to meet their specific requirements or conditions. Changes and modifications may be made without departing from the scope and spirit of the invention, as defined and limited solely by the following claims.

What is claimed is:

1. An arm assembly for a firearm, the arm assembly comprising:

a) an arm, the arm having a pintle housing, said pintle housing having an interior comprising a socket and an exterior;

b) a pintle disposed in said socket, said pintle having a groove that extends around said pintle at a first pintle height, and a plurality of substantially circular recesses disposed about said pintle at a second pintle height;

c) a rotatable adjustment knob attached to said pintle housing and rotatable relative to said pintle housing; and d) a moveable collar comprising a tongue, said moveable collar operably connected to said adjustment knob, wherein rotation of said adjustment knob causes said tongue to engage said groove in said pintle and inhibit said pintle from rotating in and retracting from said socket.

2. The arm assembly of claim 1, wherein said arm is connected to a gun mount configured to receive a firearm.

3. The arm assembly of claim 1, wherein said arm assembly comprises two arms, each arm rotatably connected to the other arm via a pintle.

4. The arm assembly of claim 1, further comprising a travel lock assembly, said travel lock assembly comprising:

a) said arm, wherein said arm is a first arm comprising two first arm travel lock apertures;

b) first and second travel lock arms, said travel lock arms each having a pivot aperture and a gun mount aperture;

c) a travel lock pivot bolt inserted through said first arm travel lock apertures and said pivot apertures; and d) a gun mount configured to receive a firearm, the gun mount having a pair of gun mount travel lock apertures, said first and second travel lock arms having a storage position wherein said travel lock arms are substantially parallel to said first arm, and a travel lock position wherein said travel lock arms are at an angle of at least 30 degrees relative to said first arm.

5. The arm assembly of claim 4, wherein said first and second travel lock arms are in said travel lock position and a travel lock pin is removably inserted through said gun mount apertures in said travel lock arms and through said gun mount travel lock apertures.

6. The arm assembly of claim 4 further comprising a travel lock brace extending from said first travel lock arm to said second travel lock arm.

7. The arm assembly of claim 6, wherein said first arm has a top surface facing said gun mount and an opposing bottom surface facing away from said gun mount, said top surface comprising a travel lock brace recess for receiving said travel lock brace when said first and second travel locks are in said storage position.

8. The arm assembly of claim 1, further comprising an assembly for mounting an apparatus with a Picatinny rail, said assembly for mounting an apparatus with a Picatinny rail comprising:

a) a Picatinny rail assembly center block, the block having a forward end, an aft end, a block length extending from the forward end to the aft end, left and right sides, a block width extending from the left side to the right side, a substantially flat top, and recesses in said left and right sides, said recesses extending substantially the entire length of said block;

b) a left plate, said left plate having a forward end, an aft end, a length extending from said forward end to said aft end, a left side, a right side configured to face said block, a width extending from said left side to said right side of said left plate, a substantially v-shaped recess in said right side of said left plate and extending substantially the entire length of said left plate;

c) a right plate, said right plate having a forward end, an aft end, a length extending from said forward end to said aft end, a left side configured to face said block, a right side, a width extending from said left side to said right side, a substantially v-shaped recess in said left side of said right plate and extending substantially the entire length of said right plate; and d) a fastener for attaching said left and said right plates to said block, wherein when said left and right plates are attached to said block by said fastener, said Picatinny rail assembly further comprising a Picatinny recess, said Picatinny recess having a floor defined by the top of said block, a left side defined by said left plate, and a right side defined by said right plate.

9. The arm assembly of claim 8, wherein a Picatinny rail of a firearm having a Picatinny rail is located in said Picatinny recess.

10. The arm assembly of claim 8, wherein a Picatinny rail of a vision scope having a Picatinny rail is located in said Picatinny recess.

11. The arm assembly of claim 8, wherein said assembly for mounting an apparatus with a Picatinny rail is removably attached to a gun mount.

12. The arm assembly of claim 8, wherein said left and said right plates are attached to said block, said left plate has a top surface situated above the top surface of said block, said left plate top surface having a height that is greatest at the left side of said left plate top surface and is lowest at the right side of said left plate top surface, and said right plate has a top surface situated above the top surface of said block, said right plate top surface having a height that is greatest at the right side of said right plate top surface and is lowest at the left side of said right plate top surface.

13. The arm assembly of claim 1, further comprising an ammunition container and gun mount assembly, said ammunition container and gun mount assembly comprising:

a) a gun mount configured to receive a firearm, the gun mount having a forward end, an aft end, a gun mount length extending from said forward end to said aft end, a left side, a right side, and a gun mount width extending from said left side to said right side, said gun mount width being shorter than said gun mount length; and b) an ammunition container configured to feed ammunition to a firearm mounted in said gun mount, the ammunition container mounted to said left side or said right side of said gun mount, the ammunition container comprising i) a top side facing the sky, the top side disposed at an angle of between about 15 degrees and about 45 degrees relative to the ground, the top side comprising a feed opening for feeding ammunition from the ammunition container into the firearm;

ii) a bottom side opposite the top side and facing the ground;

iii) an interior side facing the gun mount; and iv) an exterior side opposite the interior side and facing away from the gun mount.

14. The arm assembly of claim 13, wherein the top side further comprises a lip, said lip having an apex extending towards the sky and a base extending into said feed opening.

15. The arm assembly of claim 13, further comprising a firearm mounted in said gun mount, said firearm having a housing and a load opening for loading ammunition into said housing, and further wherein said lip is configured to feed an ammunition clip into said load opening at an angle of between about negative 15 degrees and about positive 15 degrees relative to the ground.

16. The arm assembly of claim 13 further comprising a firearm mounted in said gun mount, said firearm having a housing and a load opening for loading ammunition into said housing, and further wherein said apex is lower than said load opening.

17. The arm assembly of claim 13, wherein the bottom side of said ammunition container is disposed at an angle of between about 15 degrees and about 45 degrees relative to the ground.

18. The arm assembly of claim 13, wherein said ammunition container further comprises a handle.

19. The arm assembly of claim 13, wherein the exterior side of said ammunition container is open.

20. The arm assembly of claim 13, wherein the interior side and the bottom side of said ammunition container meet at an angle of greater than 90 degrees.

21. The arm assembly of claim 13, wherein the gun mount comprises a plurality of apertures along the gun mount length for mounting the ammunition container to the gun mount at a plurality of locations along said gun mount length.

22. The arm assembly of claim 1, further comprising:

e) a locking pin configured to engage at least one of said plurality of substantially circular recesses in said pintle and inhibit said pintle from rotating in said socket.

23. The arm assembly of claim 22, further comprising:

f) a second rotatable adjustment knob attached to said pintle housing and rotatable relative to said pintle housing, said second rotatable adjustment knob being operably connected to said locking pin such that rotation of said second rotatable adjustment knob causes said locking pin to engage at least one of said substantially circular recesses in said pintle and inhibit said pintle from rotating in said socket.

24. The arm assembly of claim 1, further comprising:

e) a second rotatable adjustment knob attached to said pintle housing and rotatable relative to said pintle housing; and f) a second moveable collar comprising a tongue, said moveable collar operably connected to said second adjustment knob, wherein rotation of said second adjustment knob causes said tongue to engage said groove in said pintle and inhibit said pintle from rotating in and retracting from said socket.

25. The arm assembly of claim 1, wherein said pintle is connected to a vehicle.

26. The arm assembly of claim 1, wherein said first pintle height and said second pintle height are different from each other such that said groove and said substantially circular recesses are located at different heights along the pintle.

* * * * *